US010119102B2

(12) United States Patent
Tollens et al.

(10) Patent No.: US 10,119,102 B2
(45) **Date of Patent: *Nov. 6, 2018**

(54) HARD SURFACE CLEANING COMPOSITIONS COMPRISING ETHOXYLATED ALKOXYLATED NONIONIC SURFACTANTS OR A COPOLYMER AND CLEANING PADS AND METHODS FOR USING SUCH CLEANING COMPOSITIONS

(71) Applicant: The Procter & Gamble Company, Cincinnati, OH (US)

(72) Inventors: Fernando Ray Tollens, Cincinnati, OH (US); Andrew James Fluxe, Lebanon, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 127 days.

This patent is subject to a terminal disclaimer.

(21) Appl. No.: 15/270,022

(22) Filed: Sep. 20, 2016

(65) Prior Publication Data

US 2017/0096623 A1 Apr. 6, 2017

Related U.S. Application Data

(60) Provisional application No. 62/236,268, filed on Oct. 2, 2015.

(51) Int. Cl.

| | |
|---|---|
| ***C11D 1/62*** | (2006.01) |
| ***C11D 1/72*** | (2006.01) |
| ***C11D 1/75*** | (2006.01) |
| ***C11D 3/20*** | (2006.01) |
| ***C11D 3/37*** | (2006.01) |
| ***C11D 3/43*** | (2006.01) |
| ***C11D 11/00*** | (2006.01) |
| ***C11D 1/722*** | (2006.01) |
| ***C11D 1/835*** | (2006.01) |
| ***C11D 17/04*** | (2006.01) |
| ***C11D 3/30*** | (2006.01) |

(52) U.S. Cl.

CPC ..... *C11D 11/0023* (2013.01); *C11D 1/62* (2013.01); *C11D 1/72* (2013.01); *C11D 1/721* (2013.01); *C11D 1/722* (2013.01); *C11D 1/75* (2013.01); *C11D 1/835* (2013.01); *C11D 3/30* (2013.01); *C11D 3/3723* (2013.01); *C11D 3/3773* (2013.01); *C11D 3/3776* (2013.01); *C11D 3/43* (2013.01); *C11D 17/049* (2013.01)

(58) Field of Classification Search

CPC .... C11D 1/62; C11D 1/72; C11D 1/75; C11D 3/20; C11D 3/37; C11D 3/43; B08B 3/04

See application file for complete search history.

(56) References Cited

U.S. PATENT DOCUMENTS

| | | | |
|---|---|---|---|
| 6,080,706 | A | 6/2000 | Blanvalet et al. |
| 2016/0120387 | A1 | 5/2016 | Deleersnyder et al. |
| 2017/0096623 | A1 | 4/2017 | Tollens et al. |
| 2017/0096626 | A1 | 4/2017 | Tollens et al. |

FOREIGN PATENT DOCUMENTS

| | | | | |
|---|---|---|---|---|
| EP | 0 342 997 | A2 | 11/1989 | |
| EP | 1 146 809 | A2 | 10/2001 | |
| EP | 2272942 | A1 | 1/2011 | |
| WO | WO 00/71662 | * | 11/2000 | ..... C11D 3/48 |
| WO | WO0071662 | A1 | 11/2000 | |
| WO | WO2017058560 | A1 | 6/2017 | |

OTHER PUBLICATIONS

Case 14589 Search Report; PCT/US2017/058957; 15 Pages; dated Feb. 5, 2018.
U.S. Appl. No. 15/342,199, filed Nov. 3, 2016, Parsons, et al.
U.S. Appl. No. 15/270,026, filed Sep. 20, 2016, Tollens, et al.
U.S. Appl. No. 15/342,207, filed Nov. 3, 2016, Parsons, et al.
P&G Case 14048M; PCT Search Report; dated Dec. 12, 2016; PCT/US2016/052564; 12 Pages.
P&G Case 14446; PCT Search Report; PCT/US2016/052565; dated Jan. 4, 2017; 10 Pages.
All Office Actions for U.S. Appl. No. 15/342,199; P&G Case 14048MR.
All Office Actions for U.S. Appl. No. 15/270,026; P&G Case 14446.
All Office Actions for U.S. Appl. No. 15/342,207; P&G Case 14589.

* cited by examiner

*Primary Examiner* — Brian P Mruk
(74) *Attorney, Agent, or Firm* — Abbey A. Lopez

(57) ABSTRACT

The present application relates liquid hard surface cleaning compositions comprising from about 0.001 wt % to about 0.015 wt % of an ethoxylated alkoxylated nonionic surfactant or a copolymer, from about 0.01 wt % to about 0.08 wt % of a quaternary compound selected from the group consisting of a $C_6$-$C_{18}$ alkyltrimethylammonium chloride, a $C_6$-$C_{18}$dialkyldimethylammonium chloride, and mixtures thereof and at least about 90 wt % water. Methods of using such compositions and cleaning pads, wipes, and cleaning implements for use with such compositions are also disclosed.

19 Claims, No Drawings

HARD SURFACE CLEANING COMPOSITIONS COMPRISING ETHOXYLATED ALKOXYLATED NONIONIC SURFACTANTS OR A COPOLYMER AND CLEANING PADS AND METHODS FOR USING SUCH CLEANING COMPOSITIONS

FIELD OF THE INVENTION

Hard surface cleaning compositions comprising ethoxylated alkoxylated nonionic surfactants or a copolymer disclosed herein and their use in improving shine on hard surfaces and reducing streaking. Methods of using such compositions and disposable premoistened wipes or cleaning pad comprising for use with such compositions are also disclosed.

BACKGROUND OF THE INVENTION

Hard surface cleaning compositions are used for cleaning and treating hard surfaces. Preferably, the hard surface cleaning composition is formulated to be an "all purpose" hard surface cleaning composition. That is, the hard surface cleaning composition is formulated to be suitable for cleaning as many different kinds of surfaces as possible. However, it historically has been challenging to formulate a hard surface cleaning composition which effectively cleans tiles, and more delicate surfaces such as stainless steel, linoleum, marble, and the like. When cleaning particularly dirty floors, film and streak residues may be left which result in low shine, and an impression that the surface is not yet sufficiently clean. In addition, such floors, washed with diluted hard surface cleaning compositions tend to be slippery with a resultant increase in the risk of falls and similar accidents. As a result, the floor is sometimes rinsed again using fresh water, in order to remove such films and streaks in order to improve the impression of cleanliness. Moreover, long drying times can result in damage to delicate surfaces, such as spotting and rusting of steel surfaces.

Hence, a need remains for a composition which provides improved shine, even after cleaning especially dirty floors. In addition, a need remains for a hard surface cleaning composition which is suitable for cleaning a variety of surfaces, and results in surfaces which have reduced streaking.

SUMMARY OF THE INVENTION

The present disclosure relates to a liquid hard surface cleaning composition comprising from about 0.001 wt % to about 0.015 wt % of an ethoxylated alkoxylated nonionic surfactant, from about 0.01 wt % to about 0.08 wt % of a quaternary compound selected from the group consisting of a $C_6$-$C_{18}$ alkyltrimethylammonium chloride, a $C_6$-$C_{18}$dialkyldimethylammonium chloride, and mixtures thereof and at least about 90 wt % water.

The present disclosure also relates to a liquid hard surface cleaning composition comprising from about 0.001 wt % to about 0.015 wt % of a copolymer; from about 0.01 wt % to about 0.08 wt % of a quaternary compound selected from the group consisting of a C6-C18 alkyltrimethylammonium chloride, a C6-C18dialkyldimethylammonium chloride, and mixtures thereof; and at least about 90 wt % water. The copolymer comprises:

a. from 60 to 99% by weight of at least one monoethylenically unsaturated polyalkylene oxide monomer of the formula I (monomer A)

I

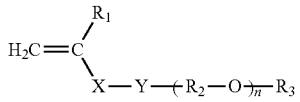

in which the variables have the following meanings:
X is —$CH_2$— or —CO—, if Y is —O—;
is —CO—, if Y is —NH—;
Y is —O— or —NH—;
$R_1$ is hydrogen or methyl;
$R_2$ are identical or different C2-C6-alkylene radicals;
$R_3$ is H or C1-C4 alkyl;
n is an integer from 5 to 100, b. from 1 to 40% by weight of at least one quaternized nitrogen-containing monomer, selected from the group consisting of at least one of the monomers of the formula IIa to IId (monomer B)

IIa

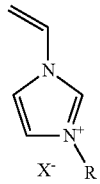

IIb

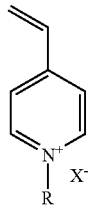

IIc

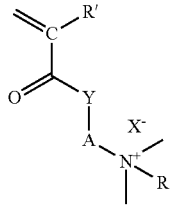

IId

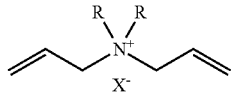

in which the variables have the following meanings:
R is C1-C4 alkyl or benzyl;
R' is hydrogen or methyl;
Y is —O— or —NH—;
A is C1-C6 alkylene;
$X^-$ is halide, C1-C4-alkyl sulfate, C1-C4-alkylsulfonate and C1-C4-alkyl carbonate, c. from 0 to 15% by weight of at least one anionic monoethylenically unsaturated monomer (monomer C), and d. from 0 to 30% by weight of at least one other non-ionic monoethylenically unsaturated monomer (monomer D), wherein:

if monomer C is present, the molar ratio of monomer B to monomer C is greater than 1, and the copolymer has a weight average molecular weight (Mw) from 20,000 g/mol to 500,000 g/mol.

The present disclosure further relates to methods for improving the shine of a hard surface comprising the steps of wetting the hard surface with such cleaning compositions and removing the cleaning composition from the hard surface with a disposable dry cleaning wipe.

The present disclosure further relates to disposable pre-moistened wipes or pads comprising such hard surface cleaning compositions.

DETAILED DESCRIPTION OF THE INVENTION

During the cleaning process, surfaces may undergo four transformations or cycles: application of the solution to wet the surface, spreading of the solution on the surface, removal of the solution from the surface that can include absorption into a cleaning substrate, and drying of any residual solution, which on horizontals surfaces, like floors, occurs mainly by evaporation. Wetting and spreading are controlled by the surface modification that occurs between the fluid and surface interface. These two phenomenona have a major impact on spotting or beading and the formation of films with both negatively affecting the appearance of the surface. Furthermore, during the drying cycle, evaporation can cause additional spotting if visible particles are left behind. All three of these cycles, i.e. wetting, spreading, and drying of the solution on the floor, although having benefits for cleaning, can also results in negatives if not addressed properly. The absorption cycle removes the cleaning solution as well as soluble and insoluble materials contained in the cleaning solution and offers the opportunity to repair the spotting and film formation negatives brought by the other cycles. A parameter that is linked to increase absorption efficiency is the receding contact angle of the cleaning solution. The receding contact angle of the solution controls how the solution wets and dewets on the surface. Low receding contact angle solutions spread and wet more, having the potential of forming films and haze, while high receding contact angle solutions may result in spotting if not absorbed or removed properly. During the drying cycle, the receding contact angle controls the degree to which solution dewets before evaporating from the surface. It was found that solutions containing a relatively low level of a ethoxylated alkoxylated nonionic surfactant or a copolymer of the present disclosure provide a moderately hydrophilic receding contact angle of preferably 8° to 22°, and most preferably 10° to 20°, that offers the best balance between efficient fluid wetting (required to reduce filming) and low beading (required to avoid spotting).

As defined herein, "essentially free of" a component means that no amount of that component is deliberately incorporated into the respective premix, or composition. Preferably, "essentially free of" a component means that no amount of that component is present in the respective premix, or composition, but may be present as trace impurities.

As used herein, "isotropic" means a clear mixture, having little or no visible haziness, phase separation and/or dispersed particles, and having a uniform transparent appearance.

As defined herein, "stable" means that no visible phase separation is observed for a premix kept at 25° C. for a period of at least two weeks, or at least four weeks, or greater than a month or greater than four months, as measured using the Floc Formation Test, described in USPA 2008/0263780 A1.

By "Low volatile organic compound hard surface cleaning composition", it is meant herein a finished product having low volatile organic compound ("VOC") content like, for example, a maximum of 0.5% by weight of the composition of VOCs, however, it is noted that fragrance is exempted from this value up to 2% by the weight of the finished product.

All percentages, ratios and proportions used herein are by weight percent of the premix, unless otherwise specified. All average values are calculated "by weight" of the premix, unless otherwise expressly indicated.

All measurements are performed at 25° C. unless otherwise specified.

Unless otherwise noted, all component or composition levels are in reference to the active portion of that component or composition, and are exclusive of impurities, for example, residual solvents or by-products, which may be present in commercially available sources of such components or compositions.

Liquid hard surface cleaning compositions:

By "liquid hard surface cleaning composition", it is meant herein a liquid composition for cleaning hard surfaces found in households, especially domestic households. Surfaces to be cleaned include kitchens and bathrooms, e.g., floors, walls, tiles, windows, cupboards, sinks, showers, shower plastified curtains, wash basins, WCs, fixtures and fittings and the like made of different materials like ceramic, vinyl, no-wax vinyl, linoleum, melamine, glass, steel, kitchen work surfaces, any plastics, plastified wood, metal or any painted or varnished or sealed surface and the like. Household hard surfaces also include household appliances including, but not limited to refrigerators, freezers, washing machines, automatic dryers, ovens, microwave ovens, dishwashers and so on. Such hard surfaces may be found both in private households as well as in commercial, institutional and industrial environments.

In a preferred embodiment, the liquid compositions herein are aqueous compositions. Therefore, they may comprise from 90% to 99.7% by weight of the total composition of water, preferably at least about 93 wt %, more preferably at least about 95 wt %, more preferably at least about 97 wt %, most preferably at least about 98 wt % water.

The compositions of the present disclosure preferably have a viscosity from 1 cps to 650 cps, more preferably of from 100 cps to 550 cps, more preferably from 150 cps to 450 cps, most preferably from 250 cps to 350 cps when measured at 20° C. with a AD1000 Advanced Rheometer from Atlas® shear rate 10 s-1 with a coned spindle of 40 mm with a cone angle 2° and a truncation of ±60 μm.

The pH is preferably from 3 to 12, more preferably from 5 to 10 and most preferably from 6 to 8. It will be understood that the compositions herein may further comprise an acid or base to adjust pH as appropriate.

A suitable acid for use herein is an organic and/or an inorganic acid. A preferred organic acid for use herein has a pKa of less than 7. A suitable organic acid is selected from the group consisting of: citric acid, lactic acid, glycolic acid, maleic acid, malic acid, succinic acid, glutaric acid and adipic acid and mixtures thereof. A suitable inorganic acid can be selected from the group consisting of: hydrochloric acid, sulphuric acid, phosphoric acid and mixtures thereof.

A typical level of such acids, when present, is from 0.001% to 1.0% by weight of the total composition, preferably from 0.005% to 0.5% and more preferably from 0.01% to 0.05%.

A suitable base to be used herein is an organic and/or inorganic base. Suitable bases for use herein are the caustic alkalis, such as sodium hydroxide, potassium hydroxide and/or lithium hydroxide, and/or the alkali metal oxides such, as sodium and/or potassium oxide or mixtures thereof. A preferred base is a caustic alkali, more preferably sodium hydroxide and/or potassium hydroxide.

Other suitable bases include ammonia, ammonium carbonate, $K_2CO_3$, $Na_2CO_3$ and alkanolamines (such as monoethanolamine, triethanolamine, aminomethylpropanol, and mixtures thereof).

Typical levels of such bases, when present, are from 0.001% to 1.0% by weight of the total composition, preferably from 0.005% to 0.5% and more preferably from 0.01% to 0.05%.

Ethoxylated Alkoxylated Nonionic Surfactant:

The liquid hard surface cleaning composition may comprise an ethoxylated alkoxylated nonionic surfactant. Preferably, the liquid hard surface cleaning composition comprises the ethoxylated alkoxylated nonionic surfactant at a level of from 0.0001 to 1% wt %, more preferably from 0.001 to 0.5 wt %, most preferably from 0.001 to 0.015 wt % of the composition. The ethoxylated alkoxylated nonionic surfactant is preferably selected from the group consisting of: esterified alkyl alkoxylated surfactant; alkyl ethoxy alkoxy alcohol, wherein the alkoxy part of the molecule is preferably propoxy, or butoxy, or propoxy-butoxy; polyoxyalkylene block copolymers, and mixtures thereof.

The preferred ethoxylated alkoxylated nonionic surfactant is an esterified alkyl alkoxylated surfactant of general formula (I):

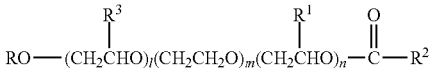

(I)

where

R is a branched or unbranched alkyl radical having 8 to 16 carbon atoms, preferably from 10 to 16 and more preferably from 12 to 15;

$R^3$, $R^1$ independently of one another, are hydrogen or a branched or unbranched alkyl radical having 1 to 5 carbon atoms; preferably $R^3$ and $R^1$ are hydrogen $R^2$ is an unbranched alkyl radical having 5 to 17 carbon atoms; preferably from 6 to 14 carbon atoms l, n independently of one another, are a number from 1 to 5 and m is a number from 8 to 50; and Preferably, the weight average molecular weight of the ethoxylated alkoxylated nonionic surfactant of formula (I) is from 950 to 2300 g/mol, more preferably from 1200 to 1900 g/mol.

R is preferably from 12 to 15, preferably 13 carbon atoms. $R^3$ and $R^1$ are preferably hydrogen. Component 1 is preferably 5. n is preferably 1. m is preferably from 13 to 35, more preferably 15 to 25, most preferably 22. $R^2$ is preferably from 6 to 14 carbon atoms.

The hard surface cleaning composition of the invention provides especially high shine when the esterified alkyl alkoxylated surfactant is as follows: R has from 12 to 15, preferably 13 carbon atoms, $R^3$ is hydrogen, $R^1$ is hydrogen, component 1 is 5, n is 1, m is from 15 to 25, preferably 22 and $R^2$ has from 6 to 14 carbon atoms and the alcohol ethoxylated has an aliphatic alcohol chain containing from 10 to 14, more preferably 13 carbon atoms and from 5 to 8, more preferably 7 molecules of ethylene oxide.

Preferably, the ethoxylated alkoxylated nonionic surfactant can be a polyoxyalkylene copolymer. The polyoxyalkylene copolymer can be a block-heretic ethoxylated alkoxylated nonionic surfactant, though block-block surfactants are preferred. Suitable polyoxyalkylene block copolymers include ethylene oxide/propylene oxide block polymers, of formula (II):

$$(EO)_x(PO)_y(EO)_x, \text{ or} \quad (II)$$

$$(PO)_x(EO)_y(PO)_x \quad (II)$$

wherein EO represents an ethylene oxide unit, PO represents a propylene oxide unit, and x and y are numbers detailing the average number of moles ethylene oxide and propylene oxide in each mole of product. Such materials tend to have higher molecular weights than most non-ionic surfactants, and as such can range between 1000 and 30000 g/mol, although the molecular weight should be above 2200 and preferably below 13000. A preferred range for the molecular weight of the polymeric non-ionic surfactant is from 2400 to 11500 Daltons. BASF (Mount Olive, N.J.) manufactures a suitable set of derivatives and markets them under the Pluronic trademarks. Examples of these are Pluronic (trademark) F77, L62 and F88 which have the molecular weight of 6600, 2450 and 11400 g/mol respectively. An especially preferred example of a useful polymeric non-ionic surfactant is Pluronic (trademark) F77.

Other suitable ethoxylated alkoxylated nonionic surfactants are described in Chapter 7 of Surfactant Science and Technology, Third Edition, Wiley Press, ISBN 978-0-471-68024-6.

The ethoxylated alkoxylated nonionic surfactant preferably provides a wetting effect of from 15 to 350 s, more preferably from 60 to 200 s, even more preferably from 75 to 150 s. The wetting effect is measured according to EN 1772, using 1 g/l of the ethoxylated alkoxylated nonionic surfactant in distilled water, at 23° C., with 2 g soda ash/l.

The ethoxylated alkoxylated nonionic surfactants preferably are low foaming non-ionic surfactants that are alkoxylated and include unbranched fatty alcohols that may contain high amounts of alkene oxide and ethylene oxide. For example, preferred ethoxylated alkoxylated nonionic surfactants may include those sold by BASF under the "Plurafac" trademark, especially Plurafac LF 131 (wetting effect of 25 s), LF 132 (wetting effect of 70 s), LF 231 (wetting effect of 40 s), LF 431 (wetting effect of 30 s), LF 1530 (wetting effect >300 s), LF 731 (wetting effect of 100 s), LF 1430 (wetting effect >300 s) and LF 7319 (wetting effect of 100 s).

The ethoxylated alkoxylated nonionic surfactants preferably are not hydrogenated and, therefore, the fatty alcohol chains do not terminate in a hydrogen group. Examples of such hydrogenated non-ionic surfactants include Plurafac 305 and Plurafac 204.

Copolymer:

The cleaning composition may comprise from 0.01% to 10%, more preferably from 0.05% to 5%, yet more preferably from 0.1% to 3%, most preferably from 0.15 to 1% by weight of the cleaning composition, of a copolymer that comprises monomers selected from the group comprising monomers of formula (III) (Monomer A) and monomers of formula (IVa-IVd) (Monomer B) (hereinafter referred to as "the copolymer"). The copolymer comprises from 60 to 99%, preferably from 70 to 95% and especially from 80 to 90% by weight of at least one monoethylenically unsaturated polyalkylene oxide monomer of the formula (III) (monomer A)

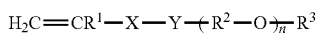

(III)

wherein Y of formula (III) is selected from —O— and —NH—; if Y of formula (III) is —O—, X of formula (III) is selected from $—CH_2—$ or —CO—, if Y of formula (III) is —NH—, X of formula (III) is —CO—; $R^1$ of formula (III) is selected from hydrogen, methyl, and mixtures thereof; $R^2$ of formula (III) is independently selected from linear or branched $C_2$-$C_6$-alkylene radicals, which may be arranged blockwise or randomly; $R^3$ of formula (III) is selected from hydrogen, $C_1$-$C_4$-alkyl, and mixtures thereof; n of formula (III) is an integer from 5 to 100, preferably from 10 to 70 and more preferably from 20 to 50.

The copolymer comprises from 1 to 40%, preferably from 2 to 30% and especially from 5 to 20% by weight of at least one quaternized nitrogen-containing monoethylenically unsaturated monomer of formula (IVa-IVd) (monomer B).

The monomers are selected such that the copolymer has a weight average molecular weight ($M_w$) of from 20,000 to 500,000 g/mol, preferably from greater than 25,000 to 150,000 g/mol and especially from 30,000 to 80,000 g/mol.

The copolymer preferably has a net positive charge at a pH of 5 or above.

The copolymer for use in the present disclosure may further comprise monomers C and/or D. Monomer C may comprise from 0% to 15%, preferably from 0 to 10% and especially from 1 to 7% by weight of the copolymer of an anionic monoethylenically unsaturated monomer.

Monomer D may comprise from 0% to 40%, preferably from 1 to 30% and especially from 5 to 20% by weight of the copolymer of other non-ionic monoethylenically unsaturated monomers.

Preferred copolymers according to the present disclosure comprise, as copolymerized Monomer A, monoethylenically unsaturated polyalkylene oxide monomers of formula (III) in which Y of formula (III) is —O—; X of formula (III) is —CO—; $R^1$ of formula (III) is hydrogen or methyl; $R^2$ of formula (III) is independently selected from linear or branched $C_2$-$C_4$-alkylene radicals arranged blockwise or randomly, preferably ethylene, 1,2- or 1,3-propylene or mixtures thereof, particularly preferably ethylene; $R^3$ of formula (III) is methyl; and n is an integer from 20 to 50.

Monomer A

A monomer A for use in the copolymer of the present disclosure may be, for example:

(a) reaction products of (meth)acrylic acid with polyalkylene glycols which are not terminally capped, terminally capped at one end by alkyl radicals; and (b) alkenyl ethers of polyalkylene glycols which are not terminally capped or terminally capped at one end by alkyl radicals.

Preferred monomer A is the (meth)acrylates and the allyl ethers, where the acrylates and primarily the methacrylates are particularly preferred. Particularly suitable examples of the monomer A are:

(a) methylpolyethylene glycol (meth)acrylate and (meth) acrylamide, methylpolypropylene glycol (meth)acrylate and (meth)acrylamide, methylpolybutylene glycol (meth)acrylate and (meth)acrylamide, methylpoly(propylene oxide-co-ethylene oxide) (meth)acrylate and (meth)acrylamide, ethylpolyethylene glycol (meth) acrylate and (meth)acrylamide, ethylpolypropylene glycol (meth)acrylate and (meth)acrylamide, ethylpolybutylene glycol (meth)acrylate and (meth)acrylamide and ethylpoly(propylene oxide-co-ethylene oxide) (meth)acrylate and (meth)acrylamide, each with 5 to 100, preferably 10 to 70 and particularly preferably 20 to 50, alkylene oxide units, where methylpolyethylene glycol acrylate is preferred and methylpolyethylene glycol methacrylate is particularly preferred;

(b) ethylene glycol allyl ethers and methylethylene glycol allyl ethers, propylene glycol allyl ethers and methylpropylene glycol allyl ethers each with 5 to 100, preferably 10 to 70 and particularly preferably 20 to 50, alkylene oxide units.

The proportion of Monomer A in the copolymer according to the present disclosure is 60% to 99% by weight, preferably 70% to 95%, more preferably from 80% to 90% by weight of the copolymer.

Monomer B

A monomer B that is particularly suitable for the copolymer of the present disclosure includes the quaternization products of 1-vinylimidazoles, of vinylpyridines, of (meth) acrylic esters with amino alcohols, in particular N,N-di-$C_1$-$C_4$-alkylamino-$C_2$-$C_6$-alcohols, of amino-containing (meth) acrylamides, in particular N,N-di-$C_1$-$C_4$-alkyl-amino-$C_2$-$C_6$-alkylamides of (meth)acrylic acid, and of diallylalkylamines, in particular diallyl-$C_1$-$C_4$-alkylamines. Suitable Monomers B have the Formula IVa to IVd:

(IVa)

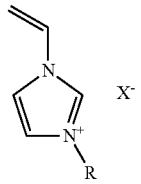

(IVb)

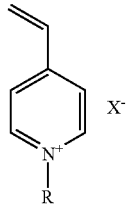

(IVc)

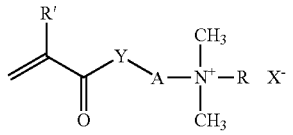

(IVd)

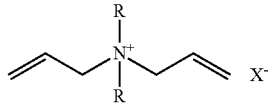

wherein R of formula IVa to IVd is selected from $C_1$-$C_4$-alkyl or benzyl, preferably methyl, ethyl or benzyl; R' of formula IVc is selected from hydrogen or methyl; Y of formula IVc is selected from —O— or —NH—; A of formula IVc is selected from $C_1$-$C_6$-alkylene, preferably straight-chain or branched $C_2$-$C_4$-alkylene, in particular 1,2-ethylene, 1,3- and 1,2-propylene or 1,4-butylene; $X^-$ of formula IVa to IVd is selected from halide, such as iodide and preferably chloride or bromide, $C_1$-$C_4$-alkyl sulfate, preferably methyl sulfate or ethyl sulfate, $C_1$-$C_4$-alkylsulfonate, preferably methylsulfonate or ethylsulfonate, $C_1$-$C_4$-alkyl carbonate; and mixtures thereof.

Specific examples of preferred monomer B that may be utilized in the present disclosure are:

(a) 3-methyl-1-vinylimidazolium chloride, 3-methyl-1-vinylimidazolium methyl sulfate, 3-ethyl-1-vinylimidazolium ethyl sulfate, 3-ethyl-1-vinylimidazolium chloride and 3-benzyl-1-vinylimidazolium chloride;

(b) 1-methyl-4-vinylpyridinium chloride, 1-methyl-4-vinylpyridinium methyl sulfate and 1-benzyl-4-vinylpyridinium chloride;

(c) 3-methacrylamido-N,N,N-trimethylpropan-1-aminium chloride, 3-acryl-N,N,N-trimethylpropan-1-aminium chloride, 3-acryl-N,N,N-trimethylpropan-1-aminium methylsulfate, 3-methacryl-N,N,N-trimethylpropan-1-aminium chloride, 3-methacryl-N,N,N-trimethylpropan-1-aminium methylsulfate, 2-acrylamido-N,N,N-trimethylethan-1-aminium chloride, 2-acryl-N,N,N-trimethylethan-1-aminium chloride, 2-acryl-N,N,N-trimethylethan-1-aminium methyl sulfate, 2-methacryl-N,N,N-trimethylethan-1-aminium chloride, 2-methacryl-N,N,N-trimethylethan-1-aminium methyl sulfate, 2-acryl-N,N-dimethyl-N-ethylethan-1-aminium ethylsulfate, 2-methacryl-N,N-dimethyl-N-ethylethan-1-aminium ethylsulfate, and (d) dimethyldiallylammonium chloride and diethyldiallylammonium chloride.

A preferred monomer B is selected from 3-methyl-1-vinylimidazolium chloride, 3-methyl-1-vinylimidazolium methyl sulfate, 3-methacryl-N,N,N-trimethylpropan-1-aminium chloride, 2-methacryl-N,N,N-trimethylethan-1-aminium chloride, 2-methacryl-N,N-dimethyl-N-ethylethan-1-aminium ethylsulfate, and dimethyldiallylammonium chloride.

The copolymer according to the present disclosure comprises 1% to 40% by weight, preferably 2% to 30%, and especially preferable from 5 to 20% by weight of the copolymer, of Monomer B. The weight ratio of Monomer A to Monomer B is preferably equal to or greater than 2:1, preferably 3:1 to 5:1.

Monomer C

As optional components of the copolymer of the present disclosure, monomers C and D may also be utilized. Monomer C is selected from anionic monoethylenically unsaturated monomers. Suitable monomer C may be selected from:

(a) α,β-unsaturated monocarboxylic acids which preferably have 3 to 6 carbon atoms, such as acrylic acid, methacrylic acid, 2-methylenebutanoic acid, crotonic acid and vinylacetic acid, preference being given to acrylic acid and methacrylic acid;

(b) unsaturated dicarboxylic acids, which preferably have 4 to 6 carbon atoms, such as itaconic acid and maleic acid, anhydrides thereof, such as maleic anhydride;

(c) ethylenically unsaturated sulfonic acids, such as vinylsulfonic acid, acrylamido-propanesulfonic acid, methallylsulfonic acid, methacrylsulfonic acid, m- and p-styrenesulfonic acid, (meth)acrylamidomethanesulfonic acid, (meth)acrylamidoethanesulfonic acid, (meth)acrylamidopropanesulfonic acid, 2-(meth)acrylamido-2-methylpropanesulfonic acid, 2-acrylamido-2-butanesulfonic acid, 3-methacrylamido-2-hydroxypropanesulfonic acid, methanesulfonic acid acrylate, ethanesulfonic acid acrylate, propanesulfonic acid acrylate, allyloxybenzenesulfonic acid, methallyloxybenzenesulfonic acid and 1-allyloxy-2-hydroxypropanesulfonic acid; and (d) ethylenically unsaturated phosphonic acids, such as vinylphosphonic acid and m- and p-styrenephosphonic acid.

The anionic Monomer C can be present in the form of water soluble free acids or in water-soluble salt form, especially in the form of alkali metal and ammonium, in particular alkylammonium, salts, and preferred salts being the sodium salts.

A preferred Monomer C may be selected from acrylic acid, methacrylic acid, maleic acid, vinylsulfonic acid, 2-(meth)acrylamido-2-methylpropanesulfonic acid and vinylphosphonic acid, particular preference being given to acrylic acid, methacrylic acid and 2-acrylamido-2-methylpropanesulfonic acid.

The proportion of monomer C in the copolymer of the present disclosure can be up to 15% by weight, preferably from 1% to 5% by weight of the copolymer.

If monomer C is present in the copolymer of the present disclosure, then, the molar ratio of monomer B to monomer C is greater than 1. The weight ratio of Monomer A to monomer C is preferably equal to or greater than 4:1, more preferably equal to or greater than 5:1. Additionally, the weight ratio of monomer B to monomer C is equal or greater than 2:1, and even more preferable from 2.5:1

Monomer D

As an optional component of the copolymer of the present disclosure, monomer D may also be utilized. Monomer D is selected from nonionic monoethylenically unsaturated monomers selected from:

(a) esters of monoethylenically unsaturated $C_3$-$C_6$-carboxylic acids, especially acrylic acid and methacrylic acid, with monohydric $C_1$-$C_{22}$-alcohols, in particular $C_1$-$C_{16}$-alcohols; and hydroxyalkyl esters of monoethylenically unsaturated $C_3$-$C_6$-carboxylic acids, especially acrylic acid and methacrylic acid, with divalent $C_2$-$C_4$-alcohols, such as methyl (meth)acrylate, ethyl (meth)acrylate, n-butyl (meth)acrylate, sec-butyl (meth)acrylate, tert-butyl (meth)acrylate, ethylhexyl (meth)acrylate, decyl (meth)acrylate, lauryl (meth) acrylate, isobornyl (meth)acrylate, cetyl (meth)acrylate, palmityl (meth)acrylate and stearyl (meth)acrylate, hydroxyethyl (meth)acrylate, hydroxypropyl (meth)acrylate and hydroxybutyl (meth)acrylate;

(b) amides of monoethylenically unsaturated $C_3$-$C_6$-carboxylic acids, especially acrylic acid and methacrylic acid, with $C_1$-$C_{12}$-alkylamines and di($C_1$-$C_4$-alkyl) amines, such as N-methyl(meth)acrylamide, N,N-dimethyl(meth)acrylamide, N-ethyl(meth)acrylamide, N-propyl(meth)acrylamide, N-tert-butyl(meth)acrylamide, N-tert-octyl(meth)acrylamide and N-undecyl (meth)acrylamide, and (meth)acrylamide;

(c) vinyl esters of saturated $C_2$-$C_{30}$-carboxylic acids, in particular $C_2$-$C_{14}$-carboxylic acids, such as vinyl acetate, vinyl propionate, vinyl butyrate, vinyl 2-ethylhexanoate and vinyl laurate;

(d) vinyl $C_1$-$C_{30}$-alkyl ethers, in particular vinyl $C_1$-$C_{18}$-alkyl ethers, such as vinyl methyl ether, vinyl ethyl ether, vinyl n-propyl ether, vinyl isopropyl ether, vinyl n-butyl ether, vinyl isobutyl ether, vinyl 2-ethylhexyl ether and vinyl octadecyl ether;

(e) N-vinylamides and N-vinyllactams, such as N-vinylformamide, N-vinyl-N-methyl-formamide, N-vinylacetamide, N-vinyl-N-methylacetamide, N-vinylimidazol, N-vinylpyrrolidone, N-vinylpiperidone and N-vinylcaprolactam;

(f) aliphatic and aromatic olefins, such as ethylene, propylene, $C_4$-$C_{24}$-α-olefins, in particular $C_4$-$C_{16}$-α-olefins, e.g. butylene, isobutylene, diisobutene, styrene and α-methylstyrene, and also diolefins with an active double bond, e.g. butadiene;

(g) unsaturated nitriles, such as acrylonitrile and methacrylonitrile.

A preferred monomer D is selected from methyl (meth) acrylate, ethyl (meth)acrylate, (meth)acrylamide, vinyl acetate, vinyl propionate, vinyl methyl ether, N-vinylformamide, N-vinylpyrrolidone, N-vinylimidazole and N-vinylcaprolactam. N-vinylimidazol is particularly preferred.

If the monomer D is present in the copolymer of the present disclosure, then the proportion of monomer D may be up to 40%, preferably from 1% to 30%, more preferably from 5% to 20% by weight of the copolymer.

Preferred copolymers of the present disclosure include:

Formula V

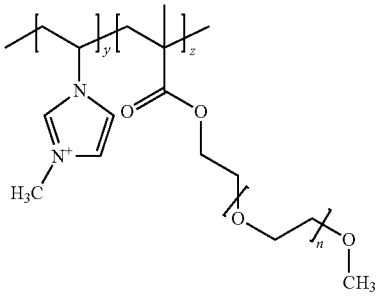

Formula VII

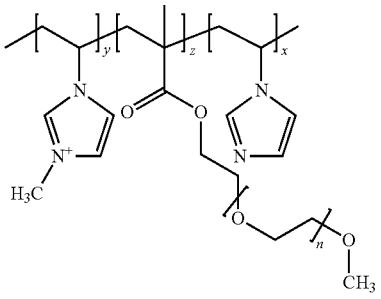

wherein indices y and z are such that the monomer ratio (z:y) is from 3:1 to 20:1 and the indices x and z are such that the monomer ratio (z:x) is from 1.5:1 to 20:1, and the polymer has a weight average molecular weight of from 20,000 to 500,000 g/mol, preferably from greater than 25,000 to 150,000 g/mol and especially from 30,000 to 80,000 g/mol.

The copolymers according to the present disclosure can be prepared by free-radical polymerization of the Monomers A and B and if desired C and/or D. The free-radical polymerization of the monomers can be carried out in accordance with all known methods, preference being given to the processes of solution polymerization and of emulsion polymerization. Suitable polymerization initiators are compounds which decompose thermally or photochemically (photoinitiators) to form free radicals, such as benzophenone, acetophenone, benzoin ether, benzyl dialkyl ketones and derivatives thereof.

The polymerization initiators are used according to the requirements of the material to be polymerized, usually in amounts of from 0.01% to 15%, preferably 0.5% to 5% by weight based on the monomers to be polymerized, and can be used individually or in combination with one another.

Instead of a quaternized Monomer B, it is also possible to use the corresponding tertiary amines. In this case, the quaternization is carried out after the polymerization by reacting the resulting copolymer with alkylating agents, such as alkyl halides, dialkyl sulfates and dialkyl carbonates, or benzyl halides, such as benzyl chloride. Examples of suitable alkylating agents which may be mentioned are, methyl chloride, bromide and iodide, ethyl chloride and bromide, dimethyl sulfate, diethyl sulfate, dimethyl carbonate and diethyl carbonate.

The anionic monomer C can be used in the polymerization either in the form of the free acids or in a form partially or completely neutralized with bases. Specific examples that may be listed are: sodium hydroxide solution, potassium hydroxide solution, sodium carbonate, sodium hydrogen carbonate, ethanolamine, diethanolamine and triethanolamine.

To limit the molar masses of the copolymers according to the present disclosure, customary regulators can be added during the polymerization, e.g. mercapto compounds, such as mercaptoethanol, thioglycolic acid and sodium disulfite. Suitable amounts of regulator are 0.1% to 5% by weight based on the monomers to be polymerized.

Quaternary Compound

The liquid hard surface cleaning composition may comprise a quaternary compound. Preferably, the liquid hard surface cleaning composition comprises the quaternary compound at a level of from 0.001 to 1% wt %, more preferably from 0.005 to 0.5 wt %, most preferably from 0.01 wt % to 0.08 wt % of the composition.

Traditionally, compositions comprising quaternary compounds tend to leave unsightly filming and/or streaking on the treated surfaces. However, compositions as presently disclosed surprisingly provide improved shine and reduced streaking Quaternary compounds useful herein are preferably selected from the group consisting of $C_6$-$C_{18}$ alkyltrimethylammonium chlorides, $C_6$-$C_{18}$dialkyldimethylammonium chlorides, and mixtures thereof. Preferably, the quaternary compound is selected from the group consisting of a $C_8$-$C_{12}$ alkyltrimethylammonium chloride, a $C_8$-$C_{12}$ dialkyldimethylammonium chloride, and mixtures thereof. Most preferably, the quaternary compound is $C_{10}$ dialkyldimethylammonium chloride.

Non-limiting examples of useful quaternary compounds include: (1) Maquat® (available from Mason), and Hyamine® (available from Lonza); (2) di($C_6$-$C_{14}$)alkyl di short chain ($C_{1-4}$ alkyl and/or hydroxyalkl) quaternary such as Uniquat® and Bardac® products of Lonza, (3) N-(3-chloroallyl) hexaminium chlorides such as Dowicil® and Dowicil® available from Dow; and (4) di($C_8$-$C_{12}$)dialkyl dimethyl ammonium chloride, such as didecyldimethylammonium chloride (Bardac 22, Uniquat 2250 or Bardac 2250), and dioctyldimethylammonium chloride (Bardac 2050).

The quaternary compounds preferably are not benzyl quats. An example of such benzyl quat includes alkyl dimethyl benzyl ammonium chloride (Uniquat QAC).

Additional Surfactant

The hard surface cleaning composition may comprise up to 5% by weight of an additional surfactant, preferably selected from: nonionic, anionic, amphoteric, zwitterionic, and mixtures thereof. More preferably, the hard surface cleaning composition can comprise from 0.001% to 2%, or from 0.001% to 1%, or from 0.001% to 0.05% by weight of the additional surfactant.

The liquid hard surface cleaning composition comprises an additional nonionic surfactant. The additional nonionic surfactant is selected from the group consisting of: alkoxylated nonionic surfactants, alkyl polyglycosides, amine oxides, and mixture thereof.

Suitable alkoxylated nonionic surfactants include primary $C_6$-$C_{16}$ alcohol polyglycol ether i.e. ethoxylated alcohols having 6 to 16 carbon atoms in the alkyl moiety and 4 to 30 ethylene oxide (EO) units. When referred to for example $C_{9-14}$ it is meant average carbons and alternative reference to for example EO8 is meant average ethylene oxide units.

Suitable alkoxylated nonionic surfactants are according to the formula RO-$(A)_n$H, wherein: R is a $C_6$ to $C_{18}$, preferably a $C_8$ to $C_{16}$, more preferably a $C_8$ to $C_{12}$ alkyl chain, or a $C_6$ to $C_{28}$ alkyl benzene chain; A is an ethoxy or propoxy or butoxy unit, and wherein n is from 1 to 30, preferably from 1 to 15 and, more preferably from 4 to 12 even more preferably from 5 to 10. Preferred R chains for use herein are the $C_8$ to $C_{22}$ alkyl chains. Even more preferred R chains for use herein are the $C_9$ to $C_{12}$ alkyl chains. R can be linear or branched alkyl chain.

Suitable ethoxylated nonionic surfactants for use herein are Dobanol® 91-2.5 (HLB=8.1; R is a mixture of $C_9$ and $C_{11}$ alkyl chains, n is 2.5), Dobanol® 91-10 (HLB=14.2; R is a mixture of $C_9$ to $C_{11}$ alkyl chains, n is 10), Dobanol® 91-12 (HLB=14.5; R is a mixture of $C_9$ to $C_{11}$ alkyl chains, n is 12), Greenbentine DE80 (HLB=13.8, 98 wt % C10 linear alkyl chain, n is 8), Marlipal 10-8 (HLB=13.8, R is a C10 linear alkyl chain, n is 8), Lialethl® 11-5 (R is a $C_{11}$ alkyl chain, n is 5), Isalchem® 11-5 (R is a mixture of linear and branched C11 alkyl chain, n is 5), Lialethl® 11-21 (R is a mixture of linear and branched $C_{11}$ alkyl chain, n is 21), Isalchem® 11-21 (R is a $C_{11}$ branched alkyl chain, n is 21), Empilan® KBE21 (R is a mixture of $C_{12}$ and $C_{14}$ alkyl chains, n is 21) or mixtures thereof. Preferred herein are Dobanol® 91-5, Neodol® 11-5, Lialethl® 11-21 Lialethl® 11-5 Isalchem® 11-5 Isalchem® 11-21 Dobanol® 91-8, or Dobanol® 91-10, or Dobanol® 91-12, or mixtures thereof. These Dobanol®/Neodol® surfactants are commercially available from SHELL. These Lutensol® surfactants are commercially available from BASF and these Tergitol® surfactants are commercially available from Dow Chemicals.

Suitable chemical processes for preparing the alkoxylated nonionic surfactants for use herein include condensation of corresponding alcohols with alkylene oxide, in the desired proportions. Such processes are well known to the person skilled in the art and have been extensively described in the art, including the OXO process and various derivatives thereof. Suitable alkoxylated fatty alcohol nonionic surfactants, produced using the OXO process, have been marketed under the tradename NEODOL® by the Shell Chemical Company. Alternatively, suitable alkoxylated nonionic surfactants can be prepared by other processes such as the Ziegler process, in addition to derivatives of the OXO or Ziegler processes.

Preferably, said alkoxylated nonionic surfactant is a $C_{9-11}$ EO5 alkylethoxylate, $C_{12-14}$ EO5 alkylethoxylate, a $C_{11}$ EO5 alkylethoxylate, $C_{12-14}$ EO21 alkylethoxylate, or a $C_{9-11}$ EO8 alkylethoxylate or a mixture thereof. Most preferably, said alkoxylated nonionic surfactant is a $C_{11}$ EO5 alkylethoxylate or a $C_{9-11}$ EO8 alkylethoxylate or a mixture thereof.

Alkyl polyglycosides are biodegradable nonionic surfactants which are well known in the art. Suitable alkyl polyglycosides can have the general formula $C_nH_{2n+1}O(C_6H_{10}O_5)_xH$ wherein n is preferably from 9 to 16, more preferably 11 to 14, and x is preferably from 1 to 2, more preferably 1.3 to 1.6. Such alkyl polyglycosides provide a good balance between anti-foam activity and detergency. Alkyl polyglycoside surfactants are commercially available in a large variety. An example of a very suitable alkyl poly glycoside product is Planteren APG 600, which is essentially an aqueous dispersion of alkyl polyglycosides wherein n is about 13 and x is about 1.4.

Suitable amine oxide surfactants include: $R_1R_2R_3NO$ wherein each of $R_1$, $R_2$ and $R_3$ is independently a saturated or unsaturated, substituted or unsubstituted, linear or branched hydrocarbon chain having from 10 to 30 carbon atoms. Preferred amine oxide surfactants are amine oxides having the following formula: $R_1R_2R_3NO$ wherein $R_1$ is an hydrocarbon chain comprising from 1 to 30 carbon atoms, preferably from 6 to 20, more preferably from 8 to 16 and wherein $R_2$ and $R_3$ are independently saturated or unsaturated, substituted or unsubstituted, linear or branched hydrocarbon chains comprising from 1 to 4 carbon atoms, preferably from 1 to 3 carbon atoms, and more preferably are methyl groups. $R_1$ may be a saturated or unsaturated, substituted or unsubstituted linear or branched hydrocarbon chain.

A highly preferred amine oxide is $C_{12}$-$C_{14}$ dimethyl amine oxide, commercially available from Albright & Wilson, $C_{12}$-$C_{14}$ amine oxides commercially available under the trade name Genaminox® LA from Clariant or AROMOX® DMC from AKZO Nobel.

The additional nonionic surfactant is preferably a low molecular weight nonionic surfactant, having a molecular weight of less than 950 g/mol, more preferably less than 500 g/mol.

The liquid hard surface cleaning composition may comprise an anionic surfactant. In one particularly preferred embodiment, the composition is essentially free of an anionic surfactant. If included, however, the anionic surfactant may be selected from the group consisting of: an alkyl sulphate, an alkyl alkoxylated sulphate, a sulphonic acid or sulphonate surfactant, and mixtures thereof.

Suitable zwitterionic surfactants typically contain both cationic and anionic groups in substantially equivalent proportions so as to be electrically neutral at the pH of use. The typical cationic group is a quaternary ammonium group, other positively charged groups like phosphonium, imidazolium and sulfonium groups can be used. The typical anionic hydrophilic groups are carboxylates and sulfonates, although other groups like sulfates, phosphonates, and the like can be used.

Some common examples of zwitterionic surfactants (such as betaine/sulphobetaine surfacants) are described in U.S. Pat. Nos. 2,082,275, 2,702,279 and 2,255,082. For example Coconut dimethyl betaine is commercially available from Seppic under the trade name of Amonyl 265®.

Lauryl betaine is commercially available from Albright & Wilson under the trade name Empigen BB/L®. A further example of betaine is Lauryl-imminodipropionate commercially available from Rhodia under the trade name Mirataine H2C-HA®.

Sulfobetaine surfactants are particularly preferred, since they can improve soap scum cleaning. Examples of suitable sulfobetaine surfactants include tallow bis(hydroxyethyl) sulphobetaine, cocoamido propyl hydroxy sulphobetaines which are commercially available from Rhodia and Witco, under the trade name of Mirataine CBS® and ReWoteric AM CAS 15® respectively.

Amphoteric surfactants can be either cationic or anionic depending upon the pH of the composition. Suitable amphoteric surfactants include dodecylbeta-alanine, N-alkyltaurines such as the one prepared by reacting dodecylamine with sodium isethionate, as taught in U.S. Pat. No. 2,658,072, N-higher alkylaspartic acids such as those taught in U.S. Pat. No. 2,438,091, and the products sold under the trade name "Miranol", as described in U.S. Pat. No. 2,528,378. Other suitable additional surfactants can be found in McCutcheon's Detergents and Emulsifers, North American Ed. 1980.

Thickener

The liquid hard surface cleaning composition can comprise a thickener. In one particularly preferred embodiment, the composition is essentially free of a thickener. An increased viscosity, especially low shear viscosity, provides longer contact time and therefore improved penetration of greasy soil and/or particulated greasy soil to improve cleaning effectiveness, especially when applied neat to the surface to be treated. Moreover, a high low shear viscosity improves the phase stability of the liquid cleaning composition, and especially improves the stability of the ethoxylated alkoxylated nonionic surfactant in compositions in the liquid hard surface cleaning composition. Hence, preferably, the liquid hard surface cleaning composition, comprising a thickener, has a viscosity of from 50 Pa·s to 650 Pa·s, more preferably 100 Pa·s to 550 Pa·s, most preferably 150 Pa·s to 450 Pa·s, at 20° C. when measured with a AD1000 Advanced Rheometer from Atlas® shear rate 10 $s^{-1}$ with a coned spindle of 40 mm with a cone angle 2° and a truncation of ±60 μm.

Suitable thickeners include polyacrylate based polymers, preferably hydrophobically modified polyacrylate polymers; hydroxyl ethyl cellulose, preferably hydrophobically modified hydroxyl ethyl cellulose, xanthan gum, hydrogenated castor oil (HCO) and mixtures thereof.

Preferred thickeners are polyacrylate based polymers, preferably hydrophobically modified polyacrylate polymers. Preferably a water soluble copolymer based on main monomers acrylic acid, acrylic acid esters, vinyl acetate, methacrylic acid, acrylonitrile and mixtures thereof, more preferably copolymer is based on methacrylic acid and acrylic acid esters having appearance of milky, low viscous dispersion. Most preferred hydrologically modified polyacrylate polymer is Rheovis® AT 120, which is commercially available from BASF.

Other suitable thickeners are hydroxethylcelluloses (HM-HEC) preferably hydrophobically modified hydroxyethylcellulose. Suitable hydroxethylcelluloses (HM-HEC) are commercially available from Aqualon/Hercules under the product name Polysurf 76® and W301 from 3V Sigma.

Hydrogenated castor oil is one preferred thickener used herein. Suitable hydrogenated castor oil is available under trade name THIXCIN R from Elementis.

Another preferred thickener used herein is a modified methacrylic acid/acrylic acid copolymer Rheovis® AT 120, which is commercially available from BASF.

When used, the liquid hard surface cleaning composition comprises from 0.0001% to 1.0% by weight of the total composition of said thickener, preferably from 0.0005% to 0.05 and most preferably from 0.001% to 0.01%.

Chelating Agent: The liquid hard surface cleaning composition can comprise a chelating agent or crystal growth inhibitor. In one particularly preferred embodiment, the composition is essentially free of a chelant. When present, chelating agent can be incorporated into the compositions in amounts ranging from 0.0001% to 1.0% by weight of the total composition, preferably from 0.0005% to 0.05 and most preferably from 0.001% to 0.01%.

Suitable phosphonate chelating agents include ethylene diamine tetra methylene phosphonates, and diethylene triamine penta methylene phosphonates (DTPMP). The phosphonate compounds may be present either in their acid form or as salts of different cations on some or all of their acid functionalities. Preferred phosphonate chelating agent to be used herein is diethylene triamine penta methylene phosphonate (DTPMP). Such phosphonate chelating agents are commercially available from Monsanto under the trade name DEQUEST®.

A preferred biodegradable chelating agent for use herein is ethylene diamine N,N'-disuccinic acid, or alkali metal, or alkaline earth, ammonium or substitutes ammonium salts thereof or mixtures thereof. Ethylenediamine N,N'-disuccinic acids, especially the (S,S) isomer have been extensively described in U.S. Pat. No. 4,704,233, Nov. 3, 1987, to Hartman and Perkins. Ethylenediamine N,N'-disuccinic acids is, for instance, commercially available under the tradename (S,S)EDDS® from Palmer Research Laboratories. Most preferred biodegradable chelating agent is L-glutamic acid N,N-diacetic acid (GLDA) commercially available under tradename Dissolvine 47S from Akzo Nobel.

Suitable amino carboxylates for use herein include ethylene diamine tetra acetates, diethylene triamine pentaacetates, diethylene triamine pentaacetate (DTPA), N-hydroxyethylethylenediamine triacetates, nitrilotriacetates, ethylenediamine tetrapropionates, triethylenetetraamine-hexa-acetates, ethanoldiglycines, and methyl glycine diacetic acid (MGDA), both in their acid form, or in their alkali metal, ammonium, and substituted ammonium salt forms. Particularly suitable amino carboxylate to be used herein is propylene diamine tetracetic acid (PDTA) which is, for instance, commercially available from BASF under the trade name Trilon FS® and methyl glycine di-acetic acid (MGDA). Most preferred aminocarboxylate used herein is diethylene triamine pentaacetate (DTPA) from BASF. Further carboxylate chelating agents for use herein include salicylic acid, aspartic acid, glutamic acid, glycine, malonic acid or mixtures thereof.

Nitrogen-Containing Polymer

The liquid hard surface cleaning composition may comprise an nitrogen-containing polymer. Nitrogen-containing polymers useful herein include polymers that contain amines (primary, secondary, and tertiary), amine-N-oxide, amides, urethanes, and/or quaternary ammonium groups. When present, it is important that the polymers herein contain nitrogen-containing groups that tend to strongly interact with the surface being treated in order to displace any present cationic quaternary compound from the surface.

Preferably, the polymers herein contain basic nitrogen groups. Basic nitrogen groups include primary, secondary, and tertiary amines capable of acting as proton acceptors. Thus the preferred polymers herein can be nonionic or cationic, depending upon the pH of the solution. Polymers useful herein can include other functional groups, in addition to nitrogen groups. The preferred polymers herein are also essentially free of, or free of, quaternary ammonium groups.

Preferably, the polymers herein are branched polymers, especially highly branched polymers including comb, graft, starburst, and dendritic structures. Preferably, the polymers herein are not linear polymers.

The nitrogen-containing polymers herein can be an unmodified or modified polyamine, especially an unmodified or modified polyalkyleneimine Preferably, the nitrogen containing polymers herein are modified polyamines Poly ($C_2$-$C_{12}$ alkyleneimines) include simple polyethyleneimines and polypropyleneimines as well as more complex polymers containing these polyamines Polyethyleneimines are common commercial materials produced by polymerization of aziridine or reaction of (di)amines with alkylenedichlorides. Polypropyleneimines are also included herein.

Although modified polyamines are preferred, linear or branched polyalkyleneimines, especially polyethyleneimines or polypropyleneimines, can be suitable in the present compositions to mitigate filming and/or streaking resulting from such compositions containing quaternary compounds. Branched polyalkyleneimines are preferred to linear polyalkyleneimines. Suitable polyalkyleneimines typically have a molecular weight of from about 1,000 to about 30,000 Daltons, and preferably from about 4,000 to about 25,000 Daltons. Such polyalkyleneimines are free of any ethoxylated and/or propoxylated groups, as it has been found that ethoxylation or propoxylation of polyalkyleneimines reduces or eliminates their ability to mitigate the filming and/or streaking problems caused by compositions containing quaternary compounds.

In preferred low-surfactant compositions for use in no-rinse cleaning methods, such compositions typically comprise nitrogen-containing polymer at a level of from about 0.005% to about 1%, preferably from about 0.005% to about 0.3%, and more preferably from about 0.005% to about 0.1%, by weight of the composition.

Examples of preferred modified polyamines useful as nitrogen-containing polymers herein are branched polyethyleneimines with a molecular weight of about 25,000 Daltons, and Lupasol® SK and Lupasol® SK(A) available from BASF.

Additional Polymers

The liquid hard surface cleaning composition may comprise an additional polymer. It has been found that the presence of a specific polymer as described herein, when present, allows further improving the grease removal performance of the liquid composition due to the specific sudsing/foaming characteristics they provide to the composition. Suitable polymers for use herein are disclosed in co-pending EP patent application EP2272942 (09164872.5) and granted European patent EP2025743 (07113156.9).

The polymer can be selected from the group consisting of: a vinylpyrrolidone homopolymer (PVP); a polyethyleneglycol dimethylether (DM-PEG); a vinylpyrrolidone/dialkylaminoalkyl acrylate or methacrylate copolymers; a polystyrenesulphonate polymer (PSS); a poly vinyl pyridine-N-oxide (PVNO); a polyvinylpyrrolidone/vinylimidazole copolymer (PVP-VI); a polyvinylpyrrolidone/poly acrylic acid copolymer (PVP-AA); a polyvinylpyrrolidone/vinylacetate copolymer (PVP-VA); a polyacrylic polymer or polyacrylicmaleic copolymer; and a polyacrylic or polyacrylic maleic phosphono end group copolymer; and mixtures thereof.

Typically, the liquid hard surface cleaning composition may comprise from 0.001% to 1.0% by weight of the total composition of said polymer, preferably from 0.005% to 0.5%, more preferably from 0.01% to 0.05% and most preferably from 0.01% to 0.03%.

Fatty Acid

The liquid hard surface cleaning composition may comprise a fatty acid as a highly preferred optional ingredient, particularly as suds supressors. Fatty acids are desired herein as they reduce the sudsing of the liquid composition when the composition is rinsed off the surface to which it has been applied.

Suitable fatty acids include the alkali salts of a $C_8$-$C_{24}$ fatty acid. Such alkali salts include the metal fully saturated salts like sodium, potassium and/or lithium salts as well as the ammonium and/or alkylammonium salts of fatty acids, preferably the sodium salt. Preferred fatty acids for use herein contain from 8 to 22, preferably from 8 to 20 and more preferably from 8 to 18 carbon atoms. Suitable fatty acids may be selected from caprylic acid, capric acid, lauric acid, myristic acid, palmitic acid, stearic acid, oleic acid, and mixtures of fatty acids suitably hardened, derived from natural sources such as plant or animal esters (e.g., palm oil, olive oil, coconut oil, soybean oil, castor oil, tallow, ground oil, whale and fish oils and/or babassu oil. For example coconut fatty acid is commercially available from KLK OLEA under the name PALMERAB 1211.

Typically, the liquid hard surface cleaning composition may comprise up to 0.5% by weight of the total composition of said fatty acid, preferably from 0.05% to 0.3%, more preferably from 0.05% to 0.2% and most preferably from 0.07% to 0.1% by weight of the total composition of said fatty acid.

Branched Fatty Alcohol

The liquid hard surface cleaning composition may comprise a branched fatty alcohol, particularly as suds suppressors. Suitable branched fatty alcohols include the 2-alkyl alkanols having an alkyl chain comprising from 6 to 16, preferably from 7 to 13, more preferably from 8 to 12, most preferably from 8 to 10 carbon atoms and a terminal hydroxy group, said alkyl chain being substituted in the $\alpha$ position (i.e., position number 2) by an alkyl chain comprising from 1 to 10, preferably from 2 to 8 and more preferably 4 to 6 carbon atoms. Such suitable compounds are commercially available, for instance, as the Isofol® series such as Isofol® 12 (2-butyl octanol) or Isofol® 16 (2-hexyl decanol) commercially available from Sasol Typically, the liquid hard surface cleaning composition may comprise up to 2.0% by weight of the total composition of said branched fatty alcohol, preferably from 0.10% to 1.0%, more preferably from 0.1% to 0.8% and most preferably from 0.1% to 0.5%.

Solvent

The liquid hard surface cleaning compositions preferably comprises a solvent. Suitable solvents may be selected from the group consisting of: ethers and diethers having from 4 to 14 carbon atoms; glycols or alkoxylated glycols; alkoxylated aromatic alcohols; aromatic alcohols; alkoxylated aliphatic alcohols; aliphatic alcohols; $C_8$-$C_{14}$ alkyl and cycloalkyl hydrocarbons and halohydrocarbons; $C_6$-$C_{16}$ glycol ethers; terpenes; and mixtures thereof.

In one preferred embodiment, the liquid hard surface cleaning composition is a Low VOC hard surface cleaning composition. Suitable organic solvents used in the present disclosure as low VOC solvents may be glycol ether based solvents selected from the group consisting of butyl carbitol, hexylcellosolve and phenoxyethanol and mixture thereof. Glycol ether based solvents are used in amount from 0.001 to 1.0% by weight of the composition, preferably from 0.01 to 0.7%, and most preferably from 0.1 to 0.5%.

Perfumes

The liquid hard surface cleaning compositions preferably comprise a perfume. Suitable perfumes provide an olfactory aesthetic benefit and/or mask any "chemical" odour that the product may have.

Other Optional Ingredients

The liquid hard surface cleaning compositions may comprise a variety of other optional ingredients depending on the technical benefit aimed for and the surface treated. Suitable optional ingredients for use herein include builders, other polymers, buffers, bactericides, hydrotropes, colorants, stabilisers, radical scavengers, abrasives, soil suspenders, brighteners, anti-dusting agents, dispersants, dye transfer inhibitors, pigments, silicones and/or dyes.

Cleaning Pad

The liquid hard surface cleaning composition may be used in combination with a cleaning pad of the present disclosure. The cleaning pad may comprise one or more layers.

The cleaning pad may comprise plural layers, to provide for absorption and storage of cleaning fluid and other liquids deposited on the target surface. The target surface will be described herein as a floor, although one of skill will recognize the invention is not so limited. The target surface can be any hard surface, such as a table or countertop, from which it is desired to absorb and retain liquids such as spill, cleaning solutions, etc.

The cleaning pad may comprise a liquid pervious floor sheet which contacts the floor during cleaning and preferably provides a desired coefficient of friction during cleaning. An absorbent core, preferably comprising AGM is disposed on, and optionally joined to an inwardly facing surface of the floor sheet. It is to be appreciated that if the cleaning pad is to be used to clean a surface other than a floor, the floor sheet may be the sheet that contacts the surface to be cleaned.

The cleaning pad may be in the form of a cleaning wipe. The cleaning wipe may be dry or pre-moistened. If the cleaning wipe is pre-moistened, it is pre-moistened with a cleaning composition, as described in further detail above, which provides for cleaning of the target surface, such as a floor, but yet does not require a post-cleaning rinsing operation.

The floor sheet of the cleaning pad or the cleaning wipe may have a thickness from about 1 mm to about 5 mm, more preferably about 1.5 mm to about 3.0 mm and most preferably about 1.2 mm.

The cleaning wipe used in conjunction with this cleaning composition may comprise natural or synthetic fibers. The fibers may be hydrophilic, hydrophobic or a combination thereof, provided that the cleaning wipe is generally absorbent to hold, and express upon demand, the above described cleaning composition. In one embodiment, the cleaning wipe may comprise at least 50 weight percent or at least 70 weight percent cellulose fibers, such as air laid SSK fibers. If desired, the cleaning wipe may comprise plural layers to provide for scrubbing, liquid storage, and other particularized tasks for the cleaning operation.

The cleaning wipe may be loaded with at least 1, 1.5 or 2 grams of the cleaning composition, as described above, per gram of dry substrate, but typically not more than 5 grams per gram.

Optionally, the cleaning wipe may further comprise a scrubbing strip. A scrubbing strip is a portion of the cleaning wipe which provides for more aggressive cleaning of the target surface. A suitable scrubbing strip may comprise a polyolefinic film, such as LDPE, and have outwardly extending perforations, etc. The scrubbing strip may be made and used according to commonly assigned U.S. Pat. Nos. 8,250,700; 8,407,848; D551,409 S and/or D614,408 S. A suitable pre-moistened cleaning wipe maybe made according to the teachings of commonly assigned U.S. Pat. No. 6,716,805; D614,408; D629,211 and/or D652,633.

Cleaning Implement

The cleaning composition according to the present application may be used with a cleaning implement. The cleaning implement may comprise a plastic head for holding a disposable cleaning wipe or pad and an elongate handle articulably connected thereto. The wipe or pad may comprise natural or synthetic fibers which may be hydrophilic, hydrophobic or a combination thereof. The handle may comprise a metal or plastic tube or solid rod. The wipe or pad may comprise one or more layers of non-woven material.

The head may have a downwardly facing surface, to which a disposable dry cleaning wipe or pad may be attached. The downwardly facing surface may be generally flat, or slightly convex. The head may further have an upwardly facing surface. The upwardly facing surface may have a universal joint to facilitate connection of the elongate handle to the head.

A hook and loop system may be used to attach a cleaning wipe directly to the bottom of the head.

Alternatively, the upwardly facing surface may further comprise a mechanism, such as resilient grippers, for removably attaching the cleaning sheet to the implement. If grippers are used with the cleaning implement, the grippers may be made according to commonly assigned U.S. Pat. Nos. 6,305,046; 6,484,346; 6,651,290 and/or D487,173.

The cleaning implement may further comprise a reservoir for storage of the cleaning composition, a described in further detail above. The reservoir may be replaced when the cleaning composition is depleted and/or refilled as desired. The reservoir may be disposed on the head or the handle of the cleaning implement of the reservoir may be separate from the cleaning implement. The neck of the reservoir may be offset per commonly assigned U.S. Pat. No. 6,390,335. The reservoir may be in the form of a spray bottle.

The cleaning composition, as described in further detail above, may be sprayed onto the target surface using a pump, using a gravity drain system or applied with steam. A suitable cleaning implement may be made according to the teachings of commonly assigned U.S. Pat. Nos. 5,888,006; 5,960,508; 5,988,920; 6,045,622; 6,101,661; 6,142,750; 6,579,023; 6,601,261; 6,722,806; 6,766,552; D477,701 and/or D487,174. A steam implement may be made according to the teachings of jointly assigned 2013/0319463.

Method of Cleaning a Surface:

Method of Cleaning a Surface

Cleaning pads, cleaning wipes, and cleaning implements using cleaning pads and cleaning wipes may be used along with a liquid hard surface cleaning composition having a receding contact of from about 8° to about 22° for cleaning hard surfaces.

Preferably cleaning pads, cleaning wipes, and cleaning implements using cleaning pads and cleaning wipes may be used along with a liquid hard surface cleaning composition having from about 0.001 wt % to about 0.015 wt % of an ethoxylated alkoxylated nonionic surface or a copolymer of the present disclosure and at least about 93 wt % water are suitable for cleaning household surfaces.

More preferably, the liquid hard surface cleaning composition is used with a cleaning pad having a floor sheet with a thickness of less than 1.2 mm or a cleaning wipe having a thickness of less than 1.2 mm Such combination of cleaning composition and cleaning pad or cleaning wipe provide improved shine and increased absorbency.

For general cleaning, especially of floors, a preferred method of cleaning comprises the steps of:

wetting a hard surface with a cleaning composition and removing the cleaning composition from the hard surface by wiping the hard surface with a cleaning pad or cleaning wipe of the present disclosure. The step of wetting the hard surface may involve spraying the hard surface with a liquid hard surface cleaning composition or contacting the hard surface with a pre-moistened wipe or cleaning pad to wet the hard surface. A cleaning implement comprising a pre-moistened or dry cleaning pad or cleaning wipe may also be used to wet and/or remove the cleaning composition from the hard surface.

Test Methods:

A) Shine Test for Floor Cleaning:

The shine test is done with soil mixture which consists of a mixture of consumer relevant soils such as oil, particulates, pet hair, sugar etc. The dark colored engineered hardwood flooring is soiled with the soil mixture and cleaned with the liquid hard surface cleaning composition(s) and a cleaning pad is wiped up and down for a total of six (6) times to cover the entire flooring, after letting them dry, results are analyzed by using grading scale described below.

| Grading in absolute scale: | PSU Scale versus Reference (average of 3 graders): |
|---|---|
| 0 = as new /no streaks and/or film | 0 = I see no difference |
| 1 = very slight streaks and/or film | 1 = I think there is difference |
| 2 = slight streaks and/or film | 2 = I am sure there is a slight difference |
| 3 = slight to moderate streaks and/or film | 3 = I am sure there is a difference |
| 4 = moderate streaks and/or film | 4 = I am sure there is a big difference |
| 5 = moderate/heavy streaks and/or film | |
| 6 = heavy streaks and/or film | |

B) Receding Contact Angle

A contact angle goniometer is used to measure the receding contact angle of the fluid. The method described herein below is derived from ASTM D5946-09.

The apparatus for measuring contact angle has: (1) a liquid dispenser capable of suspending a sessile drop, as specified, from the tip of the dispenser, (2) a sample holder that allows a sample to lay flat without unintended wrinkles or distortions, and hold the sample so that the surface being measured is horizontal, (3) provision for bringing the sample and suspended droplet towards each other in a controlled manner to accomplish droplet transfer onto the test surface, and (4) means for capturing a profile image of the drop with minimal distortion. A 5 degree lookdown angle is used, so that the line of sight is raised 5 degrees from the horizontal and the baseline of the drop is clearly visible when in contact with the sample. The apparatus has means for direct angle measurements, such as image analysis of the drop dimensions and position on the sample. A FTÅ200 dynamic contact angle video system analyzer manufactured by First Ten Angstroms, Portsmouth, Va. has been found suitable. FTÅ software supplied by First Ten Angstroms (Build 362, Version 2.1) has been found suitable. Lighting is adjusted so a clear image is resolvable by the software, to extract the baseline and droplet contour without user input.

The test liquid shall be kept in clean containers.

The substrate used for this testing is an engineered, interlocking tongue and groove planked, hardwood floor with aluminum oxide polyurethane coating. The floor has a contact angle measured with deionized water of 100 degrees+/−15 degrees and has a 60 degree gloss reading of 85+/−5 Gloss Units. A Home Legend Santos Mahogany Engineered Hardwood floor, UPC 664646301473, has been found suitable. The area of test sample (i.e., floor sheet or smoothing strip) is sufficient to prevent spreading of the test drop to the edge of the sample being tested or drops from contacting each other. The test surface is not directly touched during preparation or testing, to avoid finger contamination. The glossy surface of the floor material is carefully cleaned using an 80/20 deionized water/isopropyl alcohol solution prior to use in any test.

The temperature and humidity of the lab must be controlled to 25° C.±2° C. temperature and 40±5% humidity. Temperature and humidity is recorded during the measurement process.

The wooden flooring substrate is placed onto the specimen holder of the instrument ensuring that the substrate is lying flat and its glossy surface is facing upwards toward the test fluid droplet. A single droplet of 6.5+/−1.5 μL of the test fluid is suspended at the end of a 27 gauge syringe needle. The mounted substrate sample is brought upward until it touches the pendant drop. Droplets should not be dropped or squirted onto the substrate surface. The needle is lowered into the drop until it is at least 0.5 mm from surface. Images of the profile of the drop are collected at a rate of at least 20 images/s. The test fluid is slowly pumped at a rate of 1 μL/s until 10 μL has been added to the drop. This is the advancing contact angle portion of the test. After waiting 15 seconds, the direction of fluid flow in the syringe is reversed in order to slowly remove test fluid from the droplet on the surface of the sample at −1 μL/s until 10 μL has been removed. This is the receding contact angle portion of the measurement. The flooring substrate is moved, in order to place the next droplet of the test fluid onto a clean, undisturbed area of the substrate, preferably at least 25 mm away from any previous measurements. A total of five contact angle measurements from the receding portion of the test are taken on the substrate sample using the same test fluid.

The receding contact angle is extracted from the video immediately after the diameter of the drop retracts as test fluid is removed from the surface by suction through the needle. The drop may glide across the surface. Averaging values during this gliding portion would constitute a receding contact angle so long as the diameter of the drop is reducing. The drop may resist decreasing the diameter and collapse but not retract (tenting). Test fluid must be removed from the drop at −1 μL/s until the diameter reduces Immediately after the reduction in diameter, the contact angle is obtained as a receding contact angle. Only if the drop is almost completely removed and the diameter of the drop has not moved during the entire process (pinned) is the receding contact angle recorded as a zero.

The receding contact angle of the test fluid is reported as the average receding contact angle of the five measurements.

C) Surface Tension

The methodology used for measuring surface tension of fluid is the Wilhelmy plate method based on ASTM D1331-14 as modified hereinbelow. In short, a test liquid is brought into contact with the bottom of the Wilhelmy plate, causing the plate to be pulled down into the liquid by the surface tension force. The force applied to the plate from above is then increased to bring the bottom edge of the plate level with the flat surface of the liquid. The force acting on the plate is measured and used to calculate the surface tension of the liquid.

Device: The test is run on a tensiometer. A suitable one is the Kruss K100SF tensiometer with accompanying Laboratory Desktop software version 3.2.2.3064 with surface and interfacial tension add-in, manufactured by Kruss USA, 1020 Crews Road, Suite K Matthews, N.C. 28105, USA.

Wilhelmy Plate Dimensions: Width: 22 mm; Length: 22 mm; Thickness: 0.15 mm. The plate material is borosilicate glass microscope coverslip, such as available from Fisher Scientific (catalog #2845-22).

Measurement Settings: Surface Detection Sensitivity 0.005 g, Surface Detection Speed 3 mm/min, Measurement Time 60 sec.

The test liquid to be measured is poured into a clean and dry glass vessel. Cleaning of the glass vessel is achieved by thoroughly washing with a surfactant solution, rinsing thoroughly in deionized water, sonicating for 20 min in toluene, sonicating for 20 min in methanol, sonicating for 20 min in acetone, then drying thoroughly. The sample temperature is controlled at 23° C.±1° C. The humidity in the testing room is controlled between 50%±3% RH relative humidity.

After the tensiometer has been calibrated and leveled, the cleaned Wilhelmy plate is inserted. Care must be taken to have the sample vessel and glass plate clean. Cleaning is achieved immediately prior to use by passing the new borosilicate plate through the blue portion of a butane flame 3 times on each side in order to burn off any organic material on the plate.

The glass vessel containing the liquid to be tested is placed on the sample platform, and the platform is raised to just below the Wilhelmy plate. The lower edge of the plate is checked to be exactly horizontal by ensuring the plate edge and the image of the plate edge reflected in the test fluid are parallel. The force measuring system is tared to zero. The sample platform is raised at 3 mm/min until the lower edge of plate contacts the solvent and a mass greater than 0.005 g is detected by the microbalance. The plate is then lowered 2 mm into the fluid. The corresponding value of surface tension is read on the display of the device and is recorded.

The method is repeated 5 times using a new sample of fluid and newly cleaned plate for each replicate measurement. Plates are not re-used. The reported surface tension of the test liquid is the average of the five measurements.

D) Turbidity (NTU):

The turbidity (measured in NTU: Nephelometric Turbidity Units) is measured using a Hach 2100P turbidity meter calibrated according to the procedure provided by the manufacture. The sample vials are filled with 15 ml of representative sample and capped and cleaned according to the operating instructions. If necessary, the samples are degassed to remove any bubbles either by applying a vacuum or using an ultrasonic bath (see operating manual for procedure). The turbidity is measured using the automatic range selection.

E) pH Measurement:

The pH is measured on the neat composition, at 25° C., using a Sartarius PT-10P pH meter with gel-filled probe (such as the Toledo probe, part number 52 000 100), calibrated according to the instructions manual.

EXAMPLES

TABLE 1

Example Formulations with Test Results

| | Ex 1 Wt % | Ex 2 Wt % | Ex 3 Wt % | Ex 4 Wt % | Ex 5 Wt % |
|---|---|---|---|---|---|
| C12-14 Amine Oxide | 0.04 | 0.04 | 0.04 | 0.04 | 0.04 |
| Plurafac ™ LF7319 | 0.0 | 0.003 | 0.009 | 0.018 | |

TABLE 1-continued

Example Formulations with Test Results

| | Ex 1 Wt % | Ex 2 Wt % | Ex 3 Wt % | Ex 4 Wt % | Ex 5 Wt % |
|---|---|---|---|---|---|
| Plurafac ™ 305 | | | | | 0.009 |
| Dowanol ™ PnB | 0.5 | 0.5 | 0.5 | 0.5 | 0.5 |
| Uniquat ™ 2250 | 0.02 | 0.02 | 0.02 | 0.02 | 0.02 |
| Dow Corning 1410 | 0.002 | 0.002 | 0.002 | 0.002 | 0.002 |
| Perfume | 0.03 | 0.03 | 0.03 | 0.03 | 0.03 |
| pH | 6.5 | 6.5 | 6.5 | 6.5 | 6.5 |
| Minors and Water | to 100% | to 100% | to 100% | to 100% | to 100% |
| Receding Contact angle | 10 | 12 | 16 | 25 | 8 |
| Shine Result (absolute) | 4.50 | 4.19 | 3.78 | 5.00 | 5.00 |
| Shine Result (PSU) | Reference | +0.5 | +1.50 | −1.75 | −1.00 |

TABLE 2

Example Formulations with Test Results

| | Ex 6 Wt % | Ex 7 Wt % | Ex 8 Wt % | Ex 9 Wt % | Ex 10 Wt % |
|---|---|---|---|---|---|
| C12-14 Amine Oxide | 0.04 | 0.04 | 0.04 | 0.04 | 0.04 |
| Plurafac ™ LF7319 | 0.009 | 0.009 | 0.009 | 0.009 | 0.009 |
| Dowanol ™ PnB | 0.1 | 0.1 | 0.1 | 0.1 | 0.1 |
| Ethanol | 0.4 | 0.4 | 0.4 | 0.4 | 0.4 |
| Uniquat ™ 2250 | | 0.02 | 0.022 | 0.03 | |
| Uniquat ™ QAC | | | | | 0.03 |
| Dow Corning 1410 | 0.002 | 0.002 | 0.002 | 0.002 | 0.002 |
| Perfume | 0.03 | 0.03 | 0.03 | 0.03 | 0.03 |
| pH | 6.5 | 6.5 | 6.5 | 6.5 | 6.5 |
| Minors and Water | to 100% | to 100% | to 100% | to 100% | to 100% |
| Receding Contact angle | 10 | 16 | 16 | 18 | 30 |
| Shine Result (absolute) | 3.25 | 2.75 | 2.25 | 2.00 | 5.00 |
| Shine Result (PSU) | −1.0 | Reference | +1.75 | +2.0 | −3.0 |

TABLE 3

Example Formulations with Test Results

| | Ex 7 (from Table 2) Wt % | Ex 11 Wt % | Ex 12 Wt % | Ex 13 Wt % | Ex 14 Wt % |
|---|---|---|---|---|---|
| C12-14 Amine Oxide | 0.04 | 0.04 | 0.04 | 0.04 | 0.04 |
| Plurafac ™ LF7319 | 0.009 | | | | |
| Copolymer of Claim 17 | | 0.003 | 0.006 | 0.01 | 0.03 |
| Dowanol ™ PnB | 0.1 | 0.1 | 0.1 | 0.1 | 0.1 |
| Ethanol | 0.4 | 0.4 | 0.4 | 0.4 | 0.4 |
| Uniquat ™ 2250 | 0.02 | 0.02 | 0.02 | 0.02 | 0.02 |

TABLE 3-continued

Example Formulations with Test Results

| | Ex 7 (from Table 2) Wt % | Ex 11 Wt % | Ex 12 Wt % | Ex 13 Wt % | Ex 14 Wt % |
|---|---|---|---|---|---|
| Dow Corning 1410 | 0.002 | 0.002 | 0.002 | 0.002 | 0.002 |
| Perfume | 0.03 | 0.03 | 0.03 | 0.03 | 0.03 |
| pH | 6.5 | 6.5 | 6.5 | 6.5 | 6.5 |
| Minors and Water | to 100% | to 100% | to 100% | to 100% | to 100% |
| Receding Contact angle | 16 | 17 | 16 | 18 | 35 |
| Shine Result (absolute) | 2.75 | 2.70 | 2.50 | 2.75 | 5.00 |
| Shine Result (PSU) | Reference | −0.5 | +1.0 | −0.5 | −3.0 |

TABLE 4

Example Formulations with Test Results

| | Ex 15 Wt % | Ex 16 Wt % | Ex 17 Wt % | Ex 18 Wt % | Ex 10 Wt % |
|---|---|---|---|---|---|
| C12-14 Amine Oxide | 0.04 | 0.04 | 0.04 | 0.04 | 0.04 |
| Plurafac ™ LF7319 | 0.009 | 0.009 | 0.009 | 0.009 | |
| Dowanol ™ PnB | 0.1 | 0.1 | 0.1 | 0.1 | 0.1 |
| Ethanol | 0.4 | 0.4 | 0.4 | 0.4 | 0.4 |
| Uniquat ™ 2250 | 0.02 | 0.02 | 0.02 | | |
| Uniquat ™ QAC | | | | 0.03 | |
| Dow Corning 1410 | 0.002 | 0.002 | 0.002 | 0.002 | 0.002 |
| Perfume | 0.03 | 0.03 | 0.03 | 0.03 | 0.03 |
| pH | 6.5 | 6.5 | 6.5 | 6.5 | 6.5 |
| Minors and Water | to 100% | to 100% | to 100% | to 100% | to 100% |
| Receding Contact angle | 16 | 16 | 16 | 30 | 6 |
| Floor Sheet | Formed Film | SoftSpan | 40 gsm uSELF Bico FS | Formed Film | Formed Film |
| Floor Thickness mm | 0.5 | 1.1 | 1.4 | 0.5 | 0.5 |
| Absorption | 60 | 40 | 22 | 30 | 25 |
| Shine Result (absolute) | 2.00 | 2.75 | 3.0 | 4.00 | 5.00 |
| Shine Result (PSU) | +2.0 | Reference | −1.0 | −2.5 | −3.0 |

TABLE 5

Example Formulations with Test Results

| Product | Surface Tension (dyne/cm) | RCA | Shine ABS | Shine PUS |
|---|---|---|---|---|
| Example 7 | 27 | 16 | 2.5 | Ref |
| Windex ™ manufactured by SC Johnson (High Solvent) | 23.4 | 8 | 2.5 | +0.5 |
| Swiffer ™ Wood WetJet Cleaner manufactured by Procter & Gamble | 24.5 | 24 | 5.0 | −2.5 |
| Bona ™ Hardwood Floor (4% Solvent/Floor specific) Cleaner manufactured by Bona AB | 29.5 | 5 | 4 | −1.5 |

TABLE 5-continued

Example Formulations with Test Results

| Product | Surface Tension (dyne/cm) | RCA | Shine ABS | Shine PUS |
|---|---|---|---|---|
| Fabuloso ™ All Purpose Cleaner manufactured by Colgate-Palmolive | 25 | 22 | 5.0 | −2.5 |
| Lysol ™ Multi-Surface Cleaner manufactured by Reckitt Benckiser | 24 | 9 | 5.0 | −2.5 |
| Example 7 with Plurafac ™ LF132 instead of Plurafac LF7319 | 27 | 20 | 3.5 | −0.5 |
| Example 7 with Plurafac ™ LF305 instead of Plurafac LF7319 | 27 | 7.5 | 4.5 | −2.0 |

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm"

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present disclosure have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A liquid hard surface cleaning composition comprising:

a. from about 0.001 wt % to about 0.015 wt % of an ethoxylated alkoxylated nonionic surfactant, wherein the ethoxylated alkoxylated nonionic surfactant is an esterified alkyl alkoxylated nonionic surfactant;

b. from about 0.01 wt % to about 0.08 wt % of a quaternary compound selected from the group consisting of a $C_6$-$C_{18}$ alkyltrimethylammonium chloride, a $C_6$-$C_{18}$dialkyldimethylammonium chloride, and mixtures thereof; and c. at least about 93 wt % water.

2. The liquid hard surface cleaning composition according to claim 1, wherein the quaternary compound selected from the group consisting of a $C_8$-$C_{12}$ alkyltrimethylammonium chloride, a $C_8$-$C_{12}$ dialkyldimethylammonium chloride, and mixtures thereof.

3. The liquid hard surface cleaning composition according to claim 1, wherein the quaternary compound is $C_{10}$ dialkyldimethylammonium chloride.

4. The liquid hard surface cleaning composition according to claim 1, wherein the composition comprises at least about 95 wt % water.

5. The liquid hard surface cleaning composition according to claim 1, wherein the composition has an overall Receding Contact Angle of from about 8° to about 22°.

6. The liquid hard surface cleaning composition according to claim 1, wherein the composition has an overall Surface Tension of from about 25 dynes/cm to about 40 dynes/cm.

7. The liquid hard surface cleaning composition according to claim 1, wherein the ethoxylated alkoxylated nonionic surfactant is an esterified alkyl alkoxylated surfactant of formula (I):

Formula (I)

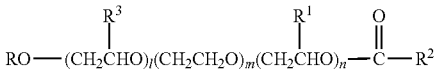

wherein:

R is a branched or unbranched alkyl radical having 8 to 16 carbon atoms;

$R^3$, $R^1$ independently of one another, are hydrogen or a branched or unbranched alkyl radical having 1 to 5 carbon atoms;

$R^2$ is an unbranched alkyl radical having 5 to 17 carbon atoms;

l , n independently of one another, are a number from 1 to 5; and m is a number from 8 to 50.

8. The hard surface cleaning composition according to claim 1, further comprising at least one amine oxide surfactant.

9. The hard surface cleaning composition according to claim 1, wherein the composition is essentially free of chelant.

10. The hard surface cleaning composition according to claim 1, wherein the composition is essentially free of an anionic surfactant.

11. The hard surface cleaning composition according to claim 1, further comprising from about 0.005 wt % to about 1 wt % of an unmodified or modified polyalkyleneimine.

12. The hard surface cleaning composition according to claim 1, further comprising a solvent selected from the group consisting of: ethers and diethers having from 4 to 14 carbon atoms; glycols or alkoxylated glycols; alkoxylated aromatic alcohols; aromatic alcohols; alkoxylated aliphatic alcohols; aliphatic alcohols; $C_8$-$C_{14}$ alkyl and cycloalkyl hydrocarbons and halohydrocarbons; $C_6$-$C_{16}$ glycol ethers; terpenes; and mixtures thereof.

13. The hard surface cleaning composition according to claim 1, wherein the composition has a pH of from 3 to 12.

14. The hard surface cleaning composition according to claim 1, wherein the viscosity of the composition is from 1 cps to 650 cps when measured at 20° C. with a AD1000 Advanced Rheometer shear rate 10 s-1 with a coned spindle of 40 mm with a cone angle 2° and a truncation of ±60 μm.

15. A method of improving shine of a hard surface, comprising the steps of:

a. wetting the hard surface with the cleaning composition of any preceding claim and b. removing the cleaning composition from the hard surface with a disposable dry cleaning wipe.

16. A liquid hard surface cleaning composition comprising:

a. from about 0.001 wt % to about 0.015 wt % of a copolymer, the copolymer comprising:

i. from 60 to 99% by weight of at least one monoethylenically unsaturated polyalkylene oxide monomer of the formula III (monomer A)

III

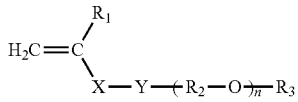

in which the variables have the following meanings:

X is —$CH_2$—or —CO—, if Y is —O—;

is —CO—, if Y is —NH—;

Y is —O—or —NH—;

$R_1$ is hydrogen or methyl;

$R_2$ are identical or different C2-C6-alkylene radicals;

$R_3$ is H or C1-C4 alkyl;

n is an integer from 5 to 100, ii. from 1 to 40% by weight of at least one quaternized nitrogen-containing monomer, selected from the group consisting of at least one of the monomers of the formula IVa to IVd (monomer B)

IVa

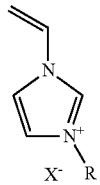

IVb

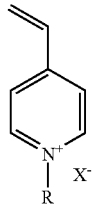

IVc

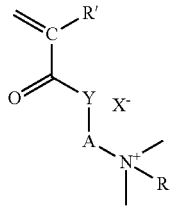

IVd

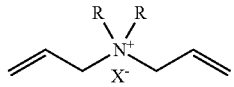

in which the variables have the following meanings:

R is C1-C4 alkyl or benzyl;

R' is hydrogen or methyl;

Y is —O—or —NH—;

A is C1-C6 alkylene;

$X^-$ is halide, C1-C4-alkyl sulfate, C1-C4-alkylsulfonate and C1-C4-alkyl carbonate, iii. from 0 to 15% by weight of at least one anionic monoethylenically unsaturated monomer (monomer C), and iv. from 0 to 30% by weight of at least one other non-ionic monoethylenically unsaturated monomer (monomer D), wherein:

if monomer C is present, the molar ratio of monomer B to monomer C is greater than 1, and the copolymer has a weight average molecular weight (Mw) from 20,000 g/mol to 500,000 g/mol;

b. from about 0.01 wt % to about 0.08 wt % of a quaternary compound selected from the group consisting of a C6-C18 alkyltrimethylammonium chloride, a $C_6$-$C_{18}$ dialkyldimethylammonium chloride, and mixtures thereof; and c. at least about 93 wt % water.

17. The liquid hard surface cleaning composition according to claim 16, wherein the quaternary compound selected from the group consisting of a $C_8$-$C_{12}$ alkyltrimethylammonium chloride, a $C_8$-$C_{12}$ dialkyldimethylammonium chloride, and mixtures thereof.

18. The liquid hard surface cleaning composition according to claim 16, wherein the composition comprises at least about 95 wt % water.

19. The liquid hard surface cleaning composition according to claim 16, wherein the composition has an overall Receding Contact Angle of from about 8° to about 22°.

* * * * *